US009828754B2

(12) United States Patent
Smith

(10) Patent No.: US 9,828,754 B2
(45) Date of Patent: Nov. 28, 2017

(54) SINK CLAMP AND METHODS

(71) Applicant: David Smith, Chattanooga, TN (US)

(72) Inventor: David Smith, Chattanooga, TN (US)

( * ) Notice: Subject to any disclaimer, the term of this patent is extended or adjusted under 35 U.S.C. 154(b) by 235 days.

(21) Appl. No.: 14/566,112

(22) Filed: Dec. 10, 2014

(65) Prior Publication Data

US 2016/0348346 A1 Dec. 1, 2016

(51) Int. Cl.
*E03C 1/33* (2006.01)

(52) U.S. Cl.
CPC ..... *E03C 1/335* (2013.01)

(58) Field of Classification Search
CPC ..... E03C 1/335; E03C 1/33
USPC ..... 4/632, 633
See application file for complete search history.

(56) References Cited

U.S. PATENT DOCUMENTS

2003/0215304 A1* 11/2003 Natero ..... E03C 1/33 411/107
2009/0307881 A1* 12/2009 Davey ..... E03C 1/33 24/457
2012/0311780 A1* 12/2012 Pridemore ..... E03C 1/33 4/633

* cited by examiner

*Primary Examiner* — Tuan N Nguyen

(57) ABSTRACT

A clamping device for mounting a sink to a counter includes a clamp having a clamp body and a binding spring, a binding lip for insertion through a first slot in the bottom surface of the countertop adjacent to the sink, the clamp and binding lip connected to the clamp body and extending away therefrom at least partially over an edge of the sink, and a clamp screw for insertion through a first opening in the clamp body and against a solid portion of the binding spring interposed between the clamp screw and the edge of the sink.

21 Claims, 2 Drawing Sheets

SINK CLAMP AND METHODS

FIELD OF THE INVENTION

The present invention relates to the countertop industry. More particularly, the present invention relates to mounting clamps which connect sinks to countertops.

BACKGROUND OF THE INVENTION

Conventional clamp methods and systems for attaching an undercounter sink to the underneath side of a counter, especially when the counter is made of granite or another hard surface, are time consuming and of ten subject to failure due to human error. In one conventional system, a sink is attached a counter using clips, typically supplied with the sink, that require drilling into the hard surface of the counter with an oversize diamond drill, inserting a threaded insert into the hole drilled therein utilizing a two-part epoxy, and then attaching the sink to the threaded insert with a screw and a clip to clamp the sink into place. This conventional system is time-consuming to install, and overtightening of the screw may cause the insert to pull out of the counter, while attaching the screw and the clip in the confined space under the counter is often difficult.

Another conventional system requires wider undercutting a slot into the hard material of the countertop and then inserting a nut fastener into the slot with the head received and retained above the slot and the shaft extending downwardly through the slot. The sink is fit over the fastener from below, and then a clip and nut are required to clamp the sink to the countertop by the fastener. This system can create a strong clamping of the sink, but is also believed to be difficult and time consuming to implement.

In another conventional system, special studs are typically glued to the underside of the countertop using a two-part epoxy, and the sink is held to the counter by tightening a clip and nut to the studs similar to the systems described above. In this system, the sink is directly attached to the counter only by gluing means, which is believed to create reliability problems. Implementation of this system is also believed to be difficult to perform in confined spaces, such as when the countertop is attached to the counter prior to installation of the sink.

Another known method is to build a wooden cradle under the countertop for the sink to rest upon. In addition to being labor intensive, this method typically renders the sink non-removable from the countertop.

A similar conventional method is to hang the sink on a wire sling attached to the base of the counter cabinet. This method, however, is also very time consuming to implement, and difficult to standardize among sinks and cabinets of varying size.

A still further method of attaching a sink to a granite or stone countertop is believed to require first cutting slots into the underside of the countertop to accept "L" shaped spring clips. Such spring clips, however, usually require at least two pieces, and must be hammered into place, which is very difficult in the confined space under the sink. This method is costly, and moreover, the required hammering action risks damaging the sink and countertop material. Additionally, extreme care must be taken when cutting the slots, which must be perpendicular to the surface of the countertop, or the countertop could be ruined. Yet another method and direction is shown in U.S. Published Patent Application No. 2012/0311780 which shows the drilling of holes into the underside of the countertop. Drilling holes into the countertop is believed to be slow in many circumstances.

SUMMARY OF THE INVENTION

The present clamping device, system, and methods are believed to allow for an advantageous quick and easy attachment of a sink to a surface of a counter.

In a preferred embodiment, a clamping device is provided for mounting a sink to a counter. The clamping device provides a clamp having a clamp body and an optional binding or clamping spring, a binding or clamping lip for insertion into a slot in a surface of the counter adjacent to a clamped article. The clamp body and binding spring are connected to the binding lip and extend away therefrom at least partially over an edge of the clamped article. A clamp screw is then inserted through an opening in the clamp body and against a portion of the binding spring interposed between the clamp screw and an edge of the clamped article.

In at least one preferred embodiment, a counter system includes a countertop, a sink configured to fit with an opening of the countertop, and plumbing, as well as at least one, if not a plurality, of clamping devices for attaching the sink to the countertop. The clamping devices include a clamp including an opening disposed toward an end of a clamp body and a binding lip inserted internal to the countertop from a bottom surface. The binding lip is integrally formed with the clamp body for insertion into a slot in a lower or bottom surface of the countertop adjacent to the sink external to a perimeter of the sink, and a clamp screw for insertion through the opening in the clamp body and against the edge of the sink or the binding spring, if utilized.

In another embodiment, a method of installing a sink to a countertop includes the steps of forming an opening in the countertop corresponding to a shape of an outer edge of the sink, the opening being smaller than a perimeter of the outer edge of the sink, positioning the sink about the opening in the countertop, grinding a plurality of slots partially through a thickness of the countertop from the bottom, the plurality of slots located adjacent to but outside of the perimeter of the outer edge of the sink, inserting a binding lip of one of a plurality of clamping devices through each respective slot to assist in holding the sink against the countertop, threading a plurality of clamp screws into a respective first opening of each of a plurality of clamp bodies of the plurality of clamping devices, each of the clamp bodies having second openings for connecting the binding spring to the clamp body, and each of the first openings preferably being disposed below the outer edge of the sink, and tightening each of the plurality of clamp screws against the outer edge of the sink (or binding springs) to securely install the sink against the countertop. The binding lips may be held by friction and/or adhesives in the slots.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
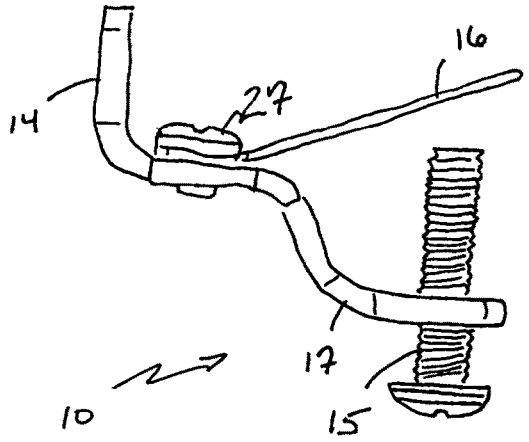
FIG. 1 is a side plan view of a clamping device, according to an embodiment.

FIG. 1 illustrates a clamping device 1 according to an embodiment. In a preferred embodiment, the clamping device 1 includes a clamp 10, a binding or clamping lip 14, and a clamp screw 15. The clamp 10 may further include a binding or clamping tab 16 and a clamp body 17 extending away from the binding lip 14 at substantially a right angle to a lengthwise direction of the binding lip 14. The clamp 10 is configured to apply force as described below.

Figure 2:
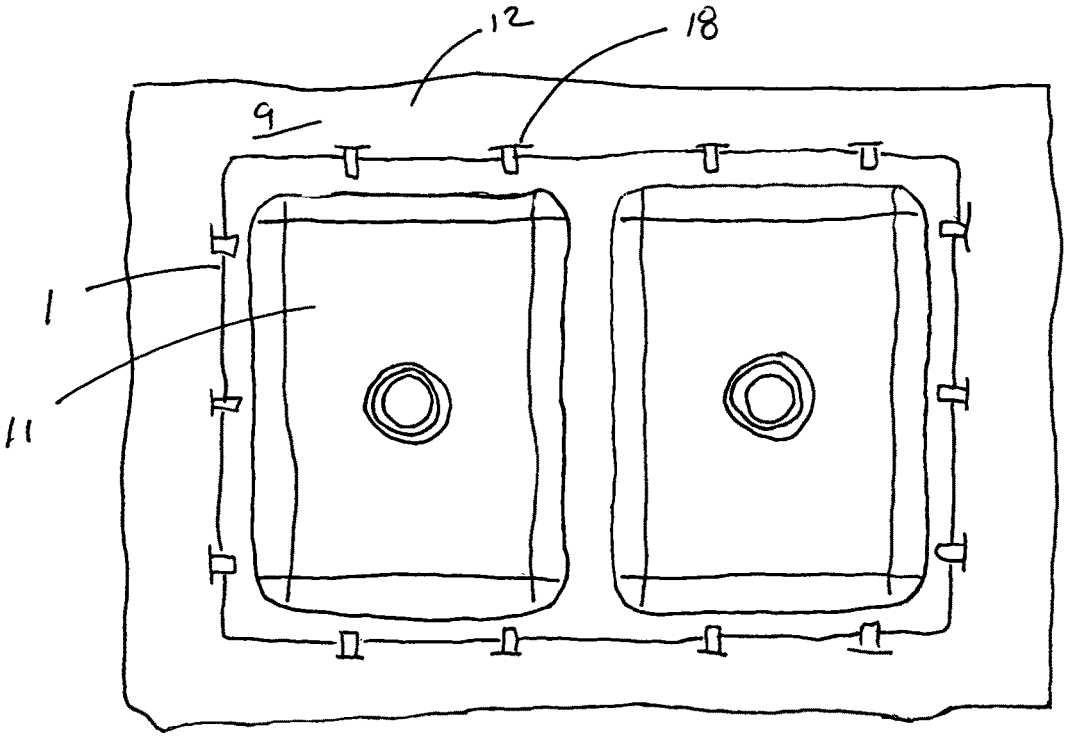
FIG. 2 is a bottom plan view of a sink attached to a counter surface utilizing the clamping devices of FIG. 1 of the presently preferred embodiment.

FIG. 2 illustrates a sink 11, which may be positioned below and about a sink opening 13, and attached to a lower/under surface of a countertop 12 by utilization of one or more of clamping devices 1. The countertop 12 may have at least one slot or a plurality of slots 18 ground into the lower surface to receive the lip 14 of a respective clamping device 1. Each slot 18 may be adjacent to a nearest edge of the sink 11. In an embodiment, a slot 18 may be ⅞" deep ground with a 4" or other diameter grinding wheel to accept an approximately sized binding lip 14. All or individual components of the clamping device 1 may be formed of rigid steel or plastic, or a material of sufficient strength to hold the sink 11 to the countertop 12 without breaking or separating. The binding spring 16 and/or clamp body 17 may be alternatively formed of spring steel, or another strong but flexible material. The binding lip 14 may be made of a rigid material, such as steel, plastic, or a reinforced resin.

Preferably the clamp 10 is a unitary or integral structure of the clamp body 17 formed with the binding lip 14 from a single material, such as a bent metal product. The clamp body 17 is preferably formed from a planar member with a single width that has been bent into a desired shape to provide the binding lip 14 as well as the clamp body 17 as illustrated. Furthermore, by manufacturing in this manner, the thickness 42 is less than half of the width 32 and in the preferred embodiments, the thickness 42 is less than ⅓ of the width 32 or less than ¼ of the width for many embodiments. This is believed to provide a more secure fit within a slot 18 such as is shown in FIG. 2. In the presently preferred embodiment, the clamping body 17 has a first portion 43 which may be parallel to a second portion 45. Clamp screw 15 is shown proceeding through first bore or hole 9 and the spring screw 47 may then be inserted through bore 15 or binding spring 16 and secured into the second hole or bore 7 as illustrated.

The clamp body 17, the binding spring 16, the binding lip 14 and the clamp screw 15 can be seen in FIG. 1.

Figure 5:
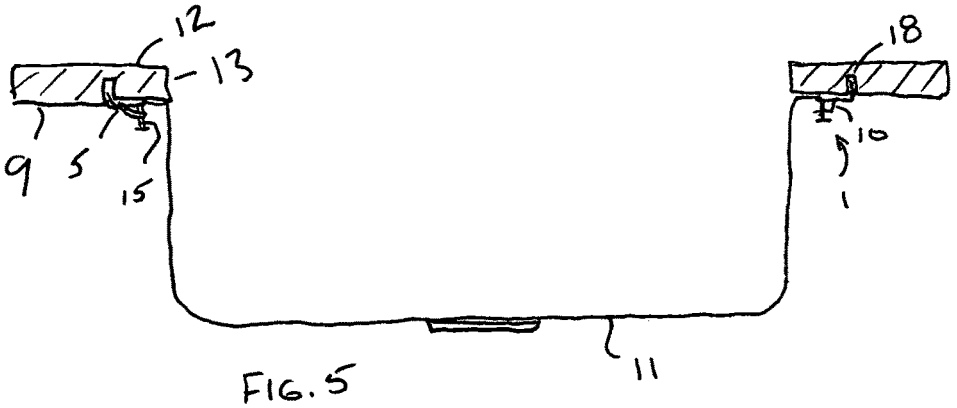
FIG. 5 is a cross sectional view of a sink attached to a counter surface utilizing the clamping devices of FIG. 1 of the presently preferred embodiment.
Figure 6:
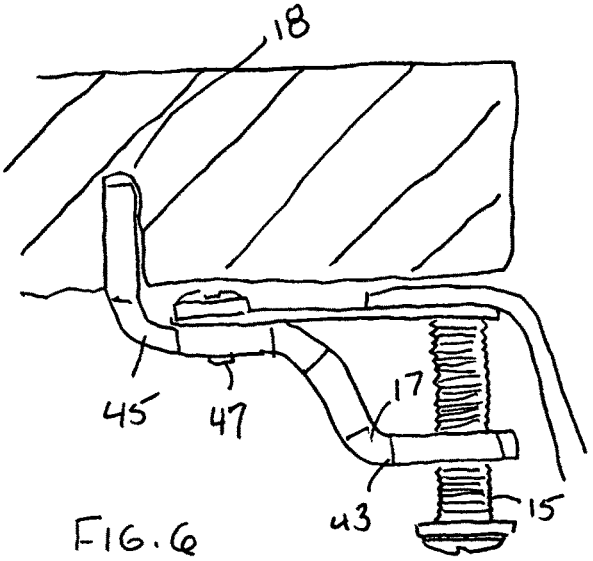
FIG. 6 is an enlarged portion of the partial sectional side view of the embodiment shown in FIG. 5.

FIG. 5 illustrates an enlarged portion of the partial sectional side view of the embodiment shown in FIG. 2. In the example of FIG. 2, the slot 18 may be formed only part of the way into the countertop 12 from its underside 9. As best seen with respect to FIGS. 1 and 2 as well, the binding lip 14 may then be inserted into the slot 18 directly. In an embodiment, the binding spring 16 may be screwed directly to the clamp body 17 at one end thereof such as with clamp screw 15.

Once the binding lip 14 is so inserted into the slot 18, the clamp screw 15 may be inserted into a first hole 9 in the clamp body 17, which itself may be positioned over a nearest edge of a rim 5 of the sink 11. Once so positioned, the clamp screw 15 may be turned (typically clockwise) in the second hole 7, which may be threaded to correspond to the threading of the clamp screw 15 to enable the clamp screw 15 to push an opposing end 3 of the binding spring 16 down against the sink rim, causing the binding lip 14 to bind in the slot 18 while simultaneously clamping the sink 11 to the countertop 12. The opposing end of the binding spring 16 may be solid, and need not include an additional opening corresponding to the clamp screw 15.

Figure 3:
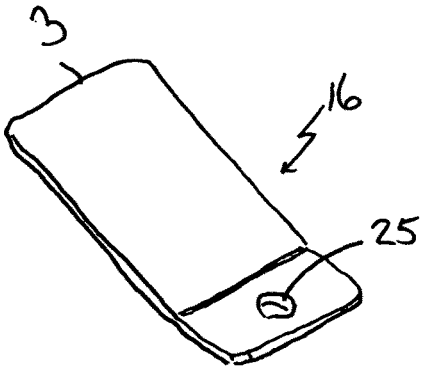
FIG. 3 is a perspective view of the binding system as shown in FIG. 1.
Figure 4:
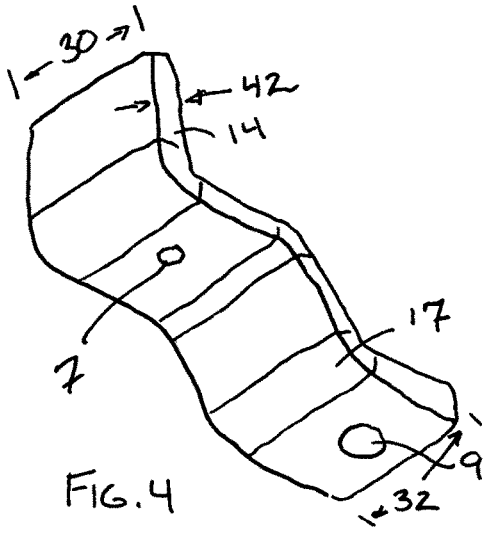
FIG. 4 is a perspective view of the clamp body as shown in FIG. 1.

In use, the sink 11 may be positioned under the sink opening 13 (or to the underside of the countertop 12 if the countertop itself has not yet been installed to a counter) in the countertop 12. In an embodiment, countertop 12 may be made of granite or another hard surface material. The binding 14 of each clamping device 1 may be received in a respective slot 18. The countertop 12 may include a plurality of slots 18 sufficient to hold the sink 11 securely to the countertop 12. The binding lip 14 may be inserted into the slot 18. The corresponding hole in the binding spring 16 may receive retainer such as rivet or spring screw 27 at first end 29 of binding spring 16 which may be opposite second end 3. The spring screw 27 may also be directed through a first hole 31 in the first clamp body 17 to retain binding spring 16 to the clamp body 12. In an embodiment, the minimal pressure may be by hand or tapping from a hammer or mallet. In an embodiment, the binding lip 14 may be held into place in the slot 18 by static friction from appropriate sizing of the slot 18 with respect to the binding lip 14 or by inclusion of a wax coating or possibly an adhesive on the binding lip 14, which may allow additional friction between the binding lip 14 and the slot 18, as best seen in FIG. 3.

Once the binding lips 14 are positioned in the respective slots 18, the clamping device 1 may be distributed around the sink 11 to support the weight of the sink 11 on the respective clamp bodies 17. While the weight of the sink 11 is so supported by the clamp bodies 17, a fitter may be able to move the sink 11 on the clamping devices 1 to fit the sink 11 into a desired position about the sink opening 13. Once the sink 11 is in the desired position about the sink opening, the clamp screw 15 may be screwed into the opposing end of the clamp body 17 away from the respective solid end of the binding spring 16 that presses against the edge of the sink 11. The tightening of the clamp screw 15 to separate the clamp body 17 and binding spring 16 at the opposing end of the clamp 10 typically causes the first end of the binding tab 16 and clamp body 17 about the binding lip 14 to securely pull against the binding lip 14 and thereby clamp the sink 11 to the work surface 12. In the fully installed position, each clamping device 1 may be capable of carrying a significantly greater amount of weight placed on each clamp body 17. A shape of the clamp 10 allows the holding strength to become stronger when more pressure is exerted to the clamp screw 15 either by torque or by separation force between clamp 10 and work surface 12.

In an embodiment, the binding lip 14 may have ridges cut into it to allow for additional gripping friction within the slot 18. A wax adhesive or sacrificial substance may additionally be applied to the binding lip 14 in this example to further aid the clamping device 1 to be pressure fitted with and into the hole 18. As best seen in FIG. 1, the opposing end of the clamp 10—including the clamp body 17 and binding spring 16—may be configured to accept sinks 11 of various edge thicknesses, or even a varying thickness around the edge of a single sink 11, without having to include additional parts to clamp the edge to countertop 12. The shape of the clamp 10 provides for a universal fitting. Additionally, according to an embodiment, the friction of the binding lip 14 within the slot 18 may, when clamped, securely hold the sink 11 to the countertop 12 when the binding lip 14 is fully inserted through the clamp 10 into the slot 18 (e.g., FIG. 1), or when the binding lip 14 is only partially inserted through the clamp into the slot 18. The binding lip may thus be of sufficient length to allow for universal fitting to countertops of varied, or varying, thicknesses, without having to shorten the length of the binding lip.

Other embodiments of the present clamping device are contemplated by the present inventor, including a clamp 10 without a binding spring 16, where the clamp body could serve as the entire clamp. In this example, the clamp screw 15 will press directly against the edge of the sink 11 when tightened, instead of the binding spring 16. The clamping device would otherwise function the same as described above. The binding lip 14 is preferably the same width 30 as the clamp body 32 and is formed of a single piece of material (i.e., a single piece of unitary material and/or integral and/or integrally formed).

In an embodiment, the sink 11 may be installed to a countertop 12 utilizing the clamping device 1 according to the following steps. The countertop 12 may first be placed bottom side up on a workbench (not shown), for easier access to a fitter. Where the countertop is made of a very heavy and hard material such as granite, it may be particularly advantageous to work on the bottom side from above the countertop 12 prior to its installation to a counter. The sink 11 may then be placed substantially into position on the bottom side of countertop 12. A mark may then be placed on the countertop 12 at a desired position of the aligning slots about the binding lip 14 of each clamping device 1 about the edge of the sink 11. In an embodiment, the respective marks may be approximately ½" from the edge or perimeter of the sink 11. The slots 18 may then be ground at each of the marks to receive the respective binding lips 14. In an embodiment, the slots 18 may be ¼' in width and ⅞" deep into a thickness of the countertop 12. The slots 18 preferably do not pass all the way through the countertop 12. The countertop 12 may then be installed onto cabinets of a counter by conventional methods.

In some embodiments, the clamping device 1 may be pre-assembled, such that the binding lip 14, clamp screw 15, binding spring 16, and clamp body 17 are fitted together to only require insertion of the binding lip into a respective slot 18 and tightening of the clamp screw 15. By these configurations, the present embodiments eliminate the need to inventory and keep track of various parts (e.g., flat clips, nuts, inserts, studs, washers, etc.) conventionally needed to attach an article, such as a sink, to a surface.

Furthermore, due to the often very crowded and limited work space available under a kitchen sink, including but not limited to plumbing supply lines and drains, it is conventionally very difficult to use two hands when installing under counter sinks from below, even though use of both hands is typically required in such conventional installations. According to the present embodiments, however, the present clamping devices and methods may be fully implemented through one-handed installation, which greatly simplifies the installation of an under counter sink from below. The binding lip 14 may be directed into the slot 18. Inserting by hand is preferred.

Another advantage to the present embodiments is that no special tooling is required to complete a sink installation. The only tooling required to accomplish the steps described above may be a standard grinder such as one having a diamond blade (if the countertop 12 is made of a hard stone material such as granite, for example). Use of a relatively small width for the slot 18, as described above, also allows for very fast and economical cutting or grinding.

According to the present embodiments described herein, the clamping device 1 may be configured such that, once the device is installed, the greater the separating force that can be achieved between the sink 11 and the countertop 12, the higher the holding power that will be realized by the device. One of ordinary skill in the art will further appreciate, after reading and comprehending the present disclosure, that a clamping device according to the present embodiments will further allow a sink that is installed as described above to be more easily removed than can be conventionally accomplished, at a later time if desired, and without risking the countertop to damage from the removal.

Changes may be made in the above methods and systems without departing from the scope hereof. The present inventor further contemplates that the many features disclosed herein may be used together or in combination with the other features disclosed among the several embodiments of the invention. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An undercounter sink attachment system comprising:

a sink having an outer edge configured to fit about an opening of a countertop having a generally vertical slot formed in a bottom surface of the countertop beside the sink, the slot extending generally alongside the outer edge of the sink when the sink is positioned about said opening under the countertop; and a clamping device for attaching the sink to the countertop, the clamping device having:

a clamp body having an insertable end, said insertable end being configured to insert into the slot of the countertop above the clamp body in an upward insertion direction; and a clamping spring connected to the clamp body, the clamping spring in a relaxed state including a deflectable portion extending upwardly form the clamp body forming an upward angle, said upward angle of the relaxed deflectable spring portion configured to be deflected by contact of the deflectable spring portion with a peripheral portion of the sink toward an angle of the peripheral sink portion to transmit an upward clamping force to said portion of the sink when the insertable end is inserted into the slot, wherein the clamping spring has a hole and the clamping spring is connected to the clamp body by a fastener horizontally offset from the insertable end.

2. The undercounter sink attachment system of claim 1 wherein the fastener comprising one of a screw and a rivet extending through the hole in the clamping spring and through a spring attachment opening in the clamp body.

3. The undercounter sink attachment system of claim 2, further comprising a clamping screw extending threadably through a clamping screw opening in the clamp body, the clamping screw configured to transmit a generally upward force to one of the clamping spring and the portion of the sink to at least assist in holding the sink to the bottom surface of the countertop when the insertable end is inserted into the slot.

4. The undercounter sink attachment system of claim 3 wherein the clamping screw and spring attachment openings are located on first and second respective portions of the clamp body, and said first and second portions are parallel.

5. The undercounter sink attachment system of claim 3 the insertable end being comprised in a vertical portion of the clamp body bent approximately perpendicularly relative to a horizontal portion of the clamp body that comprises said clamping screw opening.

6. The undercounter sink attachment system of claim 1 further comprising a plurality of similarly constructed clamping devices securing the sink to the countertop.

7. The undercounter sink attachment system of claim 1, said clamp body including said insertable end being integrally formed from a single piece of material.

8. The undercounter sink attachment system of claim 1, wherein the clamping spring is a leaf spring, and the deflected angle of the deflectable portion of the clamping spring is configured to be aligned with the angle of the peripheral sink portion when the insertable end of the clamping device is inserted into the countertop slot.

9. The undercounter sink attachment system of claim 1, the clamping spring further comprising a generally flat connecting portion connected to the clamp body, and said deflectable spring portion comprising a generally flat portion of the clamping spring.

10. The undercounter sink attachment system of claim 9, the clamping spring further comprising a sharp bend disposed between the connecting spring portion and the deflectable spring portion.

11. A clamping device for mounting a sink to a countertop comprising:

a clamp body;

an insertable end of the clamp body, said insertable end being configured for insertion in an upward insertion direction into a slot in a bottom surface of a countertop about a perimeter of a sink, and a width of the slot extending generally alongside the perimeter of the sink; and a clamping spring connected to the clamp body, the clamping spring in a relaxed state including a deflectable portion extending at an upward angle, the deflectable spring portion in said relaxed state configured to contact a portion of the sink when the insertable end is partially inserted into said slot and to be deflected by contact with the portion of the sink to transmit an upward clamping spring force to the portion of the sink when the insertable end is further inserted into said slot, wherein the clamping spring has a hole and the clamping spring is connected to the clamp body by a fastener horizontally offset from the insertable end.

12. The clamping device of claim 11 wherein the fastener comprising one of a screw and a rivet extending through the hole in the clamping spring and through a spring attachment opening in the clamp body.

13. The clamping device of claim 12, further comprising a clamping screw configured to be inserted through a clamping screw opening in the clamp body, wherein, when the insertable end is inserted into the slot, the clamp body is located so that the clamping screw inserted through said clamping screw opening in the clamp body transmits a generally upward clamping screw force to one of the clamping spring and the portion of the sink to at least assist in holding the sink to the bottom surface of the countertop.

14. The clamping device of claim 13 wherein the clamping screw and spring attachment openings are located on first and second respective portions of the clamp body, and said first and second portions are parallel.

15. The clamping device of claim 13 the insertable end being comprised in a vertical portion of the clamp body bent approximately perpendicularly relative to a horizontal portion of the clamp body that comprises said clamping screw opening.

16. The clamping device of claim 13, the clamping spring comprising an opening to permit the clamping screw to extend through the opening to contact directly said portion of the sink.

17. The clamping device of claim 11 the clamping spring being removable from the clamp body, and the clamping screw configured to contact the portion of the sink directly, to transmit said generally upward force to the portion of the sink to at least assist in holding the sink to the bottom surface of the countertop, when the clamping spring is removed, the insertable end is inserted into the slot, and the perimeter of the sink is disposed alongside the slot.

18. The clamping device of claim 11, said clamp body including said insertable end being integrally formed from a single piece of material.

19. The clamping device of claim 11, the clamping spring further comprising a generally flat connecting portion connected to the clamp body, and said deflectable spring portion comprising a generally flat portion of the clamping spring.

20. The clamping device of claim 19, the clamping spring further comprising a sharp bend disposed between the connecting spring portion and the deflectable spring portion.

21. A method of installing a sink to a countertop, a perimeter of the sink being configured to fit about an opening of the countertop, comprising:

forming a slot extending generally upwardly into a bottom surface of the countertop, the slot having a width longer than a thickness of the slot, the width of the slot extending alongside the perimeter of the sink when the sink is positioned under the countertop;

inserting an insertable end of a clamp body of a clamping device into the slot;

when the insertable end is partially inserted into the slot, contacting a portion of the sink with a deflectable end portion of a clamping spring connected to the clamp body, the deflectable portion extending away from the insertable end of the clamp body at an upward angle when the clamping spring is in a relaxed state; and when the insertable end is further inserted into the slot, deflecting said deflectable spring portion against the portion of the sink to transmit a generally upward clamping spring force to the portion of the sink, wherein the clamping spring has a hole and the clamping spring is connected to the clamp body by a fastener horizontally offset from the insertable end.

* * * * *